US011187117B2

(12) United States Patent
von Schimonsky et al.

(10) Patent No.: US 11,187,117 B2
(45) Date of Patent: Nov. 30, 2021

(54) HYDRAULICS UNIT FOR AN INTERNAL COMBUSTION ENGINE WITH HYDRAULICALLY VARIABLE GAS EXCHANGE VALVE GEAR

(71) Applicant: Schaeffler Technologies AG & Co. KG, Herzogenaurach (DE)

(72) Inventors: Lothar von Schimonsky, Gerhardshofen (DE); Nicola Morelli, Herzogenaurach (DE); Steffen Pfeiffer, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 439 days.

(21) Appl. No.: 16/327,370

(22) PCT Filed: Sep. 29, 2017

(86) PCT No.: PCT/DE2017/100833
§ 371 (c)(1),
(2) Date: Feb. 22, 2019

(87) PCT Pub. No.: WO2018/065010
PCT Pub. Date: Apr. 12, 2018

(65) Prior Publication Data

US 2021/0293162 A1 Sep. 23, 2021

(30) Foreign Application Priority Data

Oct. 5, 2016 (DE) ..... 102016219297.3

(51) Int. Cl.
*F01L 9/14* (2021.01)
*F01L 9/11* (2021.01)

(52) U.S. Cl.
CPC .. *F01L 9/14* (2021.01); *F01L 9/11* (2021.01)

(58) Field of Classification Search
CPC ... F01L 2001/34446; F01L 13/00; F01L 1/24; F01L 2001/34426; F01L 13/065;
(Continued)

(56) References Cited

U.S. PATENT DOCUMENTS 4,278,233 A * 7/1981 Zurner ..... F01L 9/11 251/57
5,154,143 A * 10/1992 Stutzenberger ..... F01L 9/14 123/90.12

(Continued)

FOREIGN PATENT DOCUMENTS

DE 102013213695 A1 1/2015
EP 1243761 A1 9/2002

(Continued)

*Primary Examiner* — Patrick Hamo
*Assistant Examiner* — Wesley G Harris

(57) ABSTRACT

A hydraulics unit for an internal combustion engine with a hydraulically variable gas exchange valve gear, is provided that includes a hydraulic housing having a pressure chamber, a pressure relief chamber and a venting duct. The venting duct is connected, on a hydraulic housing inner side, to the pressure relief chamber via a restriction and opens on a hydraulic housing outer side. The venting duct has a siphon with a downward first duct section and an upward second duct section, respectively in the direction of gravity and in the venting direction. When a gas exchange valve is closed, a lowermost section of the siphon is below a boundary of a pressure chamber defined by a slave piston.

13 Claims, 2 Drawing Sheets

(58) Field of Classification Search
CPC ... F01L 13/06; F01L 1/181; F01L 9/10; F01L 9/14; F01L 9/11; F01L 1/26; F01L 9/12; F02D 13/04
USPC ..... 123/90.12, 90.15, 321
See application file for complete search history.

(56) References Cited

U.S. PATENT DOCUMENTS

| | | | | |
|---|---|---|---|---|
| 5,537,976 | A * | 7/1996 | Hu | F01L 9/11 123/322 |
| 5,680,841 | A * | 10/1997 | Hu | F01L 13/06 123/322 |
| 2005/0000476 | A1 | 1/2005 | Vanderpoel | |
| 2010/0294220 | A1 | 11/2010 | Ferreri et al. | |
| 2011/0259288 | A1* | 10/2011 | Rinnert | F01L 9/11 123/90.13 |

FOREIGN PATENT DOCUMENTS

| | | | |
|---|---|---|---|
| EP | 1544421 | A2 | 6/2005 |
| EP | 1653057 | A1 | 5/2006 |
| EP | 2060754 | A2 | 5/2009 |
| EP | 2138680 | A1 | 12/2009 |
| EP | 2653703 | A1 | 10/2013 |
| JP | 2009013936 | A | 1/2009 |

* cited by examiner

HYDRAULICS UNIT FOR AN INTERNAL COMBUSTION ENGINE WITH HYDRAULICALLY VARIABLE GAS EXCHANGE VALVE GEAR

CROSS-REFERENCE TO RELATED APPLICATIONS

This application is the U.S. National Phase of PCT Application No. PCT/DE2017/100833 filed Sep. 29, 2017 which claims priority to DE 102016219297.3 filed Oct. 5, 2016, the entire disclosures of which are incorporated by reference herein.

TECHNICAL FIELD

This disclosure relates to a hydraulics unit for an internal combustion engine with a hydraulically variable gas exchange valve gear.

BACKGROUND

DE 10 2013 213 695 A1 discloses a hydraulics unit of a fully variable hydraulic valve timing system. The hydraulics unit is mounted on the cylinder head of an internal combustion engine and the hydraulic chambers thereof vent air downward into the cylinder head—in the direction of gravity.

The venting of the hydraulic system during operation brings about the discharge of the air bubbles carried along by the hydraulic fluid from the inside into the environment of the hydraulic housing and thus prevents an excessive quantity of air entering the pressure chamber and remaining there, in which case it would compromise to an impermissible extent the rigidity of the hydraulic fluid required for hydraulic actuation of the gas exchange valves. However, on the other hand, venting also promotes leakage of the hydraulic fluid from the hydraulic housing when the internal combustion engine is switched off. This is because the cooling hydraulic fluid, which shrinks in volume during this process, produces a vacuum in the hydraulic chambers, and this is compensated by the induction of additional air via the vent duct. During this pressure compensation, gravity ensures that the hydraulic chambers empty into the environment owing to leakage through the guide clearance between the slave piston and the hydraulic housing. Thus, when the internal combustion engine is stopped for a prolonged period, there is an increased risk that the hydraulic chambers will empty completely and the air in the pressure chamber will compromise the pressure buildup in the pressure chamber to such an extent, owing to the high compressibility, that the opening of the gas exchange valve required for the starting of the internal combustion engine will be prevented.

EP 2 060 754 A2 proposes a hydraulics unit having an additional low-pressure chamber, which communicates for the purpose of venting with the interior of the cylinder head via a housing opening in a position which is high in relation to the direction of gravity, i.e. geodetically, and with the pressure relief chamber via a restriction in a geodetically low position. The low-pressure chamber forms an extended hydraulic reservoir which supplies the pressure chamber with sufficient air-free hydraulic fluid during the starting of the internal combustion engine. However, the problem explained above is not eliminated thereby but only mitigated since the time taken for the pressure chamber to empty is merely lengthened somewhat.

SUMMARY

The problem addressed by the present disclosure is to develop a hydraulics unit of the type stated at the outset in such a way that the hydraulic leakage from the hydraulic housing is reduced to an extent such that the hydraulic fluid in the pressure chamber does not fall below a level critical for the starting process of the internal combustion engine, even after said engine has been stopped for a prolonged period.

The solution to this problem is obtained from the features of the disclosure described herein. According to this, the vent duct should have a siphon with a first duct section leading downward and a second duct section leading upward, in each case in relation to the direction of gravity and to the direction of venting. The lowermost section of the siphon extends below the boundary of the pressure chamber defined by the slave piston when the gas exchange valve is closed.

The siphon has two functions: on the one hand, the upward-leading second duct section thereof forms a hydraulic reservoir which is filled with hydraulic fluid at the time when the internal combustion engine is switched off and which subsequently compensates partially or completely—depending on the volume of the reservoir—for the cooling-induced shrinkage of the hydraulic fluid in the hydraulic chambers. On the other hand, the fall in the level which occurs during this process in the second duct section brings about (via the communicating tubes) a corresponding shortening of the hydraulic or oil column acting on the slave piston, with the result that the low pressure in the pressure chamber ideally completely prevents the leakage thereof.

Advantageous developments and embodiments of this disclosure are described herein. According to this, the vent duct should have a third duct section, which adjoins the second duct section and (likewise) leads downward as far as the duct opening on the housing outer side in relation to the direction of gravity and the direction of venting. This design embodiment with a drilled vent duct leading downward into the cylinder head of the internal combustion engine and, from a production standpoint, preferably opening on the lower side of the hydraulic housing makes it possible to close off the upper side of the cylinder head completely with respect to the environment by means of the hydraulics unit. In the case of a vent system opening on the upper side of the hydraulics unit, in contrast, there is a need for a cylinder head cover for closing off and hence of an additional component.

The dimensioning of the vent duct, which determines the volume of the hydraulic reservoir, can also be relevant for the state in which the level in the lowermost section of the siphon falls to such an extent that back suction of air via the first duct section is unavoidable. It is only above a minimum size of the duct cross section that air bubbles can rise therein without pushing the overlying oil column in front of them and displacing it into the pressure relief chamber. Since the air bubbles sucked back rise through the oil column standing in the first duct section and this oil column as it were closes up again, the leakage-inhibiting vacuum in the hydraulic housing is maintained. In the case of an oil with the viscosity index 0W20 and in the case of the first duct section with a circular cross section advantageous for manufacture, the inside diameter thereof should be at least 6 mm. Particularly good and robust results have been achieved with an inside diameter of about 8 mm.

BRIEF DESCRIPTION OF THE DRAWINGS

Further features of this disclosure will be found in the following description and in the drawings, in which two illustrative embodiments of the disclosure are illustrated schematically. Unless stated otherwise, identical or functionally identical features or components are provided with identical reference signs here. In the drawings.

DETAILED DESCRIPTION

Figure 1:
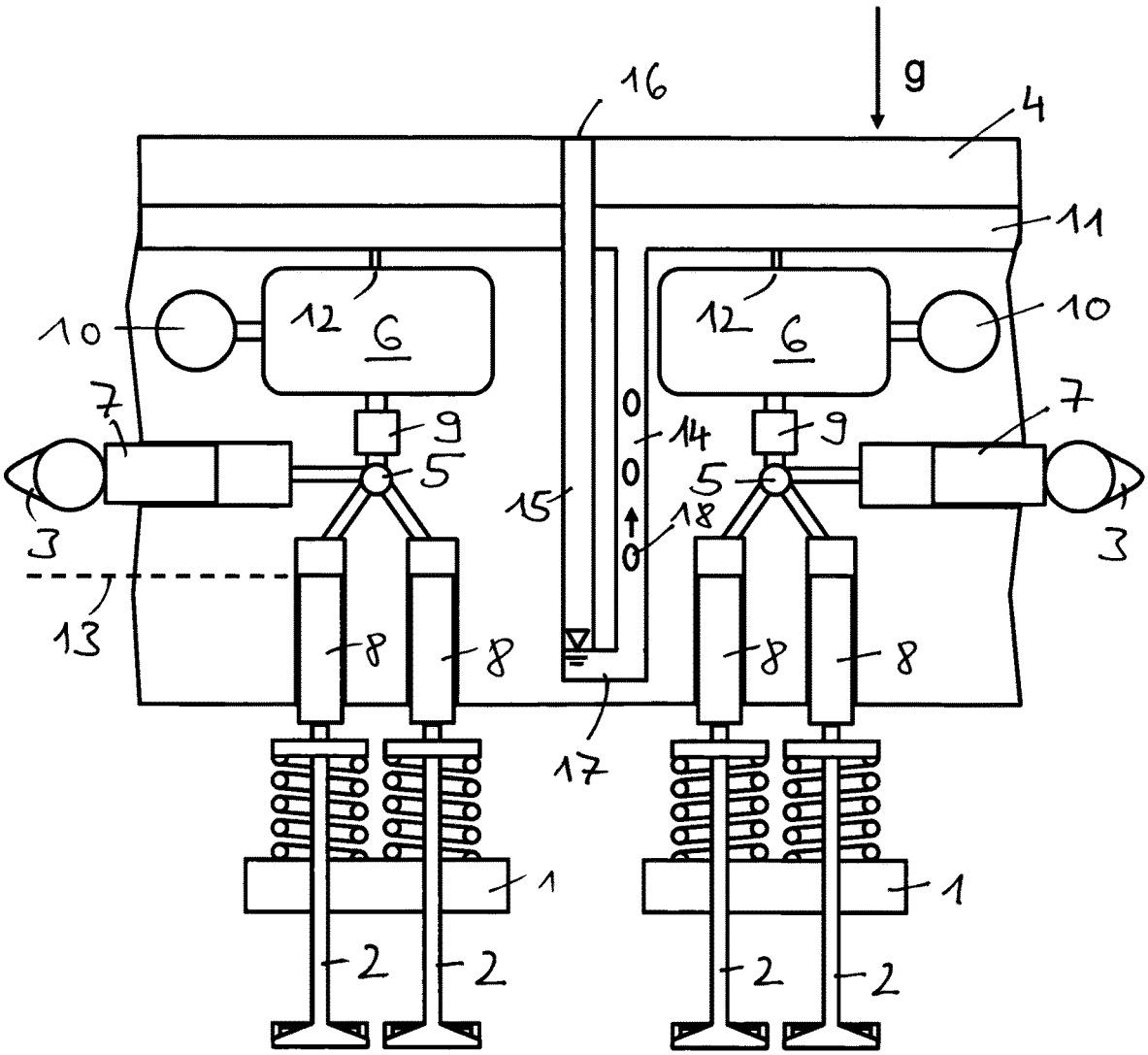
FIG. 1 shows the first illustrative embodiment with a vent duct opening at the top.

FIG. 1 shows schematically the section of the internal combustion engine which is essential to the understanding of the disclosure, having a hydraulically variable gas exchange valve gear. It illustrates a cylinder head 1 having two gas exchange valves 2 of the same type per cylinder and associated cams 3 of a camshaft, the valves being subject to a spring force in the closing direction. The variability of the gas exchange valve gear is produced in a known manner by means of a hydraulics unit arranged between the cams 3 and the gas exchange valves 2. This unit comprises a hydraulic housing 4, which is secured in the cylinder head 1 and in which one pressure chamber 5 and one pressure relief chamber 6 are formed and one master piston 7 is guided for each cylinder, said piston being driven on the housing outer side by the cam 3 and defining the pressure chamber 5 on the housing inner side. Two slave pistons 8 per cylinder are furthermore guided in the hydraulic housing 4, said pistons driving the gas exchange valves 2 on the housing outer side and defining the common pressure chamber 5 on the housing inner side. A respective electromagnetic hydraulic valve 9, in the present case a normally open 2/2-way valve, interrupts the connection between the pressure relief chamber 6 and the pressure chamber 5 in the closed state. In the open state of the hydraulic valve 9, some of the hydraulic fluid displaced by the master piston 7 can flow off into the pressure relief chamber 6 without participating in the actuation of the slave piston 8 and of the associated gas exchange valve 2. A piston-type pressure accumulator 10 for receiving the displaced hydraulic fluid is connected to each pressure relief chamber 6. The pressure relief chambers 6 are connected via a hydraulic connection (not shown) on the hydraulic housing 4 to the hydraulic circuit, i.e. the oil circuit of the internal combustion engine.

The operation of the hydraulic gas exchange valve gear, which is known per se, can be summarized in that the pressure chamber 5 between the master piston 7 and the slave piston 8 acts as a hydraulic linkage. Here, the hydraulic fluid, which is displaced by the master piston 7 proportionally to the lift of the cam 3—neglecting leaks—is divided in accordance with the opening time and the opening duration of the hydraulic valve 9 into a first partial volume, which acts on the slave piston 8, and a second partial volume, which flows off into the pressure relief chamber 6, including the piston-type pressure accumulator 10. This enables fully variable setting of the stroke transmission of the master piston 7 to the slave piston 8 and consequently not only of the timings but also of the lift height of the gas exchange valves 2.

The pressure relief chambers 6 are connected to a common vent duct 11 in the hydraulic housing 4, which removes the air bubbles carried into the hydraulic housing 4 from the hydraulic circuit during operation into the cylinder head from the hydraulic chambers. On the housing inner side, the vent duct 11 is hydraulically connected, via restrictions 12, to the respective pressure relief chamber 6 and opens on the housing outer side into the interior of the cylinder head 1. Geodetically, i.e. in relation to the direction of gravity g symbolized by the arrow, the vent duct 11 extends above the restrictions 12, the pressure relief chambers 6 and the pressure chambers 5, which are defined at the level of the boundary 13 by the slave pistons 8 when the latter are fully retracted into the hydraulic housing 4 with the gas exchange valves 2 closed.

The vent duct 11 has a siphon with a first duct section 14 in each case leading geodetically downward downstream in the direction of venting and a second duct section 15 leading upward, which ends at the duct opening 16 on the housing outer side with the upper side of the hydraulic housing 4.

Shortly after the internal combustion engine is switched off, the hydraulic housing 4 is in the vented state, in which the vent duct 11 is completely filled with hydraulic fluid as far as the duct opening 16. FIG. 1 shows the filling level at a significantly later time, at which the hydraulic fluid has cooled fully to ambient temperature and the volume thereof has shrunk accordingly. The volume compensation is accomplished by the fall in the hydraulic fluid in the second duct section 15 as far as the illustrated level in the lowermost section 17 of the siphon. This lowermost section 17 extends geodetically below the boundary 13, with the result that the oil column standing in the first duct section 14 produces a leakage-inhibiting vacuum in the pressure chambers 5.

In an alternative embodiment, which is not illustrated, the first and the second duct section can be drilled obliquely relative to one another, in which case the lowermost section of the siphon would be formed by the intersection of the two duct sections.

In the case where the volume compensation leads to a further fall in the level illustrated and air is admitted to the lowermost section 17 of the siphon, air bubbles 18 may additionally be sucked into the hydraulic chambers owing to the vacuum. The inside diameter of the first duct section 14, which, at between 8 mm and 9 mm, is significantly larger than the size of the air bubbles 18, enables the air bubbles 18 to migrate upward through the oil column situated therein, and enables the oil column to close again after the air bubbles 18 have passed through. This maintains the vacuum, which inhibits hydraulic leakage into the cylinder head 1 through the guide clearance between the slave pistons 8 and the hydraulic housing 4 and thus—in addition to the volume compensation from the second duct section 15—delays the critical emptying of the pressure chambers 5.

Figure 2:
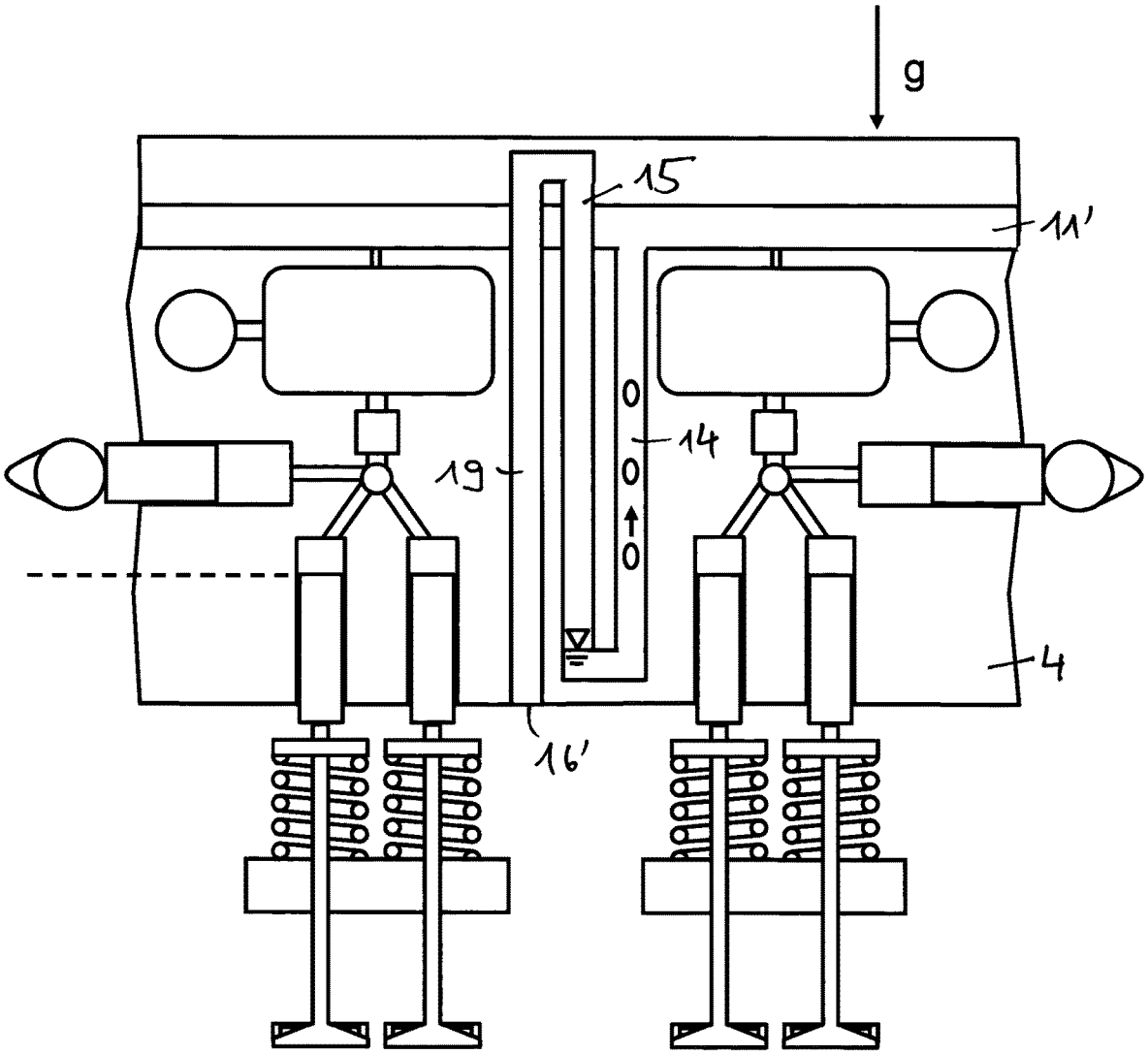
FIG. 2 shows the second illustrative embodiment with a vent duct opening at the bottom.

The illustrative embodiment illustrated in FIG. 2 differs from the embodiment explained above only in the geodetically low positioning of the duct opening 16' on the hydraulic housing 4. In this case, the vent duct 11' has a third duct section 19, which adjoins the second duct section 15 and, like the first duct section 14, leads geodetically downward—likewise in relation to the direction of gravity and to the direction of venting—and the duct opening 16' of which on the housing outer side is on the lower side of the hydraulic housing 4 and, in the present case, ends with the lower side thereof.

In another embodiment, which is not illustrated, the duct opening of the vent duct which is on the housing outer side can open below the level of a hydraulic reservoir which is formed, for example, in the cylinder head outside the hydraulic housing. Without compromising the venting of the hydraulic chambers in the hydraulic housing, this prevents air from being sucked back into the hydraulic chambers via the vent duct when the internal combustion engine is stopped.

LIST OF REFERENCE CHARACTERS

1 cylinder head
2 gas exchange valve
3 cam
4 hydraulic housing
5 pressure chamber
6 pressure relief chamber
7 master piston
8 slave piston
9 hydraulic valve
10 piston-type pressure accumulator
11 vent duct
12 restriction
13 boundary
14 first duct section
15 second duct section
16 duct opening
17 lowermost section of the siphon
18 air bubble
19 third duct section

The invention claimed is:

1. A hydraulics unit for an internal combustion engine with a hydraulically variable gas exchange valve gear, comprising:

a hydraulic housing having:
a pressure chamber,
a pressure relief chamber, and,
a vent duct, and,
the pressure chamber, the pressure relief chamber and the vent duct connected to one another hydraulically, a master piston guided within the hydraulic housing, the master piston driven on a housing outer side by a cam and defining the pressure chamber on a housing inner side, a slave piston, guided within the hydraulic housing, the slave piston driving a gas exchange valve on the housing outer side and defining the pressure chamber on the housing inner side, and a hydraulic valve, which in a closed state, interrupts a hydraulic connection between the pressure relief chamber and the pressure chamber, and, the vent duct is connected on the housing inner side via a restriction to the pressure relief chamber, and opens on the housing outer side, wherein the vent duct has a siphon with a first duct section extending downward and a second duct section extending upward, in each case in relation to a direction of gravity and a direction of venting, and, a lowermost section of the siphon extends below a boundary of the pressure chamber defined by the slave piston when the gas exchange valve is closed.

2. The hydraulics unit as claimed in claim 1, further comprising a third duct section of the vent duct, the third duct section adjoining the second duct section and extending downward and forming a duct opening on the housing outer side in relation to the direction of gravity and the direction of venting.

3. The hydraulics unit as claimed in claim 2, wherein the duct opening is arranged on a lower side of the hydraulic housing in relation to the direction of gravity.

4. The hydraulics unit as claimed in claim 1, wherein the first duct section has a circular cross section with an inside diameter of at least 6 mm.

5. A hydraulics unit configured for a hydraulically variable gas exchange gear of an internal combustion engine, the hydraulics unit comprising:

a hydraulic housing having:
a pressure chamber;
a pressure relief chamber; and,
a vent duct; and,
the pressure chamber, pressure relief chamber, and vent duct connected to one another hydraulically;

a master piston guided within the hydraulic housing, the master piston defining the pressure chamber on a housing inner side and configured to be driven on a housing outer side by a cam;

a slave piston guided within the hydraulic housing, the slave piston defining the pressure chamber on the housing inner side and configured to drive a gas exchange valve on the housing outer side; and, a hydraulic valve capable of hydraulically connecting or hydraulically disconnecting the pressure relief chamber and the pressure chamber; and, the vent duct connected on the housing inner side, via a restriction, to the pressure relief chamber and opening on the housing outer side, wherein the vent duct has a siphon with a first duct section extending downward and a second duct section extending upward, in each case in relation to a direction of gravity and a direction of venting, wherein a lowermost section of the siphon extends below a boundary of the pressure chamber defined by the slave piston in a gas exchange valve closed position.

6. The hydraulics unit as claimed in claim 5, wherein the hydraulic valve is configured to allow hydraulic fluid flow: i) from the pressure relief chamber to the pressure chamber; and, ii) from the pressure chamber to the pressure relief chamber.

7. The hydraulics unit as claimed in claim 5, further comprising a third duct section of the vent duct, the third duct section adjoining the second duct section and extending downward and forming a duct opening on the housing outer side in relation to the direction of gravity and the direction of bleeding.

8. The hydraulics unit as claimed in claim 7, wherein the duct opening is arranged on a lower side of the hydraulic housing in relation to the direction of gravity.

9. The hydraulics unit as claimed in claim 7, wherein the duct opening is below a boundary of the pressure chamber defined by the slave piston.

10. The hydraulics unit as claimed in claim 5, wherein the first duct section has a circular cross section with an inside diameter of at least 6 mm.

11. The hydraulics unit as claimed in claim 5, wherein the vent duct connects to the restriction above the pressure relief chamber and the pressure chamber in relation to the direction of gravity.

12. The hydraulics unit as claimed in claim 5, wherein an end of the second duct section forms a duct opening on an upper side of the hydraulic housing in relation to the direction of gravity.

13. The hydraulics unit as claimed in claim 12, wherein the duct opening is above the pressure relief chamber and the pressure chamber in relation to the direction of gravity.

* * * * *